US005676629A

United States Patent [19]

Andersson

[11] Patent Number: 5,676,629

[45] Date of Patent: Oct. 14, 1997

[54] METHOD AND AN APPARATUS FOR TRANSFERRING TABS TO A CONTINUOUS MATERIAL WEB

[75] Inventor: Ingvar Andersson, Löddeköpinge, Sweden

[73] Assignee: Tetra Laval Holdings & Finance S.A., Pully, Switzerland

[21] Appl. No.: 383,439

[22] Filed: Feb. 3, 1995

[30] Foreign Application Priority Data

Feb. 18, 1994 [SE] Sweden ..... 9400560

[51] Int. Cl.[6] ..... B31B 1/60

[52] U.S. Cl. ..... 493/379; 493/380; 493/382; 493/383; 156/566; 156/567; 156/568

[58] Field of Search ..... 493/379, 383, 493/380, 382, 417, 418, 424, 425, 426; 156/566, 567, 568; 271/94, 243, 244, 245, 196, 197

[56] References Cited

U.S. PATENT DOCUMENTS

| | | | |
|---|---|---|---|
| 2,313,163 | 3/1943 | Neal | 271/243 |
| 4,029,537 | 6/1977 | Kish | 156/568 |
| 4,190,244 | 2/1980 | Risi | 156/568 |
| 4,253,902 | 3/1981 | Yada . | |
| 4,293,369 | 10/1981 | Dilot et al. . | |
| 4,371,364 | 2/1983 | Rausing . | |
| 4,468,912 | 9/1984 | Lewis et al. | 493/379 |
| 4,508,330 | 4/1985 | Jörss | 156/568 |
| 4,782,987 | 11/1988 | Giacomelli et al. . | |
| 5,061,334 | 10/1991 | Paules | 156/568 |
| 5,102,485 | 4/1992 | Keeler et al. | 156/568 |
| 5,116,452 | 5/1992 | Eder | 156/568 |
| 5,344,519 | 9/1994 | Galchefski et al. | 156/568 |

FOREIGN PATENT DOCUMENTS

| | | |
|---|---|---|
| 0 584 021 | 2/1994 | European Pat. Off. . |
| 973421 | 11/1982 | U.S.S.R. . |
| 2 208 840 | 4/1989 | United Kingdom . |

*Primary Examiner*—Joseph J. Hail, III
*Assistant Examiner*—Darren Ark
*Attorney, Agent, or Firm*—Burns, Doane, Swecker & Mathis, L.L.P.

[57] ABSTRACT

A method and apparatus for transferring tabs to a continuous material web in connection with the manufacture of packaging material in conversion machines includes the use of a transfer wheel which is located between a supply station for tabs and a deposit station, in which the wheel is located in contact with the packaging material web. With the aid of retainer jaws displaceable in a circumferential direction of the wheel, and fixedly disposed abutments, the position of each tab transferred to the wheel is corrected before the tab reaches the deposit station, so that the transfer to the packaging material web takes place in accurate register with markings previously provided on the web. The method and apparatus is well-suited for use in connection with continuous material webs travelling at high rates of speed, such as 400 to 500 meters/minute.

14 Claims, 1 Drawing Sheet

METHOD AND AN APPARATUS FOR TRANSFERRING TABS TO A CONTINUOUS MATERIAL WEB

TECHNICAL FIELD

The present invention relates to a method for regularly transferring tabs to a continuous material web with the aid of a wheel which abuts against the web and whose peripheral speed corresponds to the speed of the web. The present invention also relates to an apparatus for transferring tabs to a continuous material web in register with markings previously provided on the web, the apparatus including a rotary wheel disposed between the web and a tab supply station.

BACKGROUND ART

Consumer packages of the single-use disposable type, for example, juice and milk are normally manufactured from a laminated packaging material which includes layers of paper, aluminium foil and thermoplastic. The paper imparts the desired rigidity to a packaging container manufactured from the material, the aluminium foil provides a good gas and light barrier and the thermoplastic serves the twin purpose of, on the one hand, ensuring that the packaging material is liquid-tight and, on the other hand, making possible heat sealing (fusion) of the material. Packaging containers which are manufactured from this material type are often also provided with opening arrangements, for example in the form of prefabricated apertures which are covered by fixedly sealed tear-off strips or tabs of plastic (so-called pull-tabs), or in the form of openable seam joints which include a tear-off strip accessible from the outside of the packaging container.

When packaging material of the above-mentioned type in sheet or web form is converted by means of known packaging machines into filled and sealed packaging containers, the tear-off strip parts or tabs necessary for providing the pertinent opening arrangement are applied in immediate connection with the reforming of the packaging material into individual packaging containers, i.e. in or immediately ahead of the packing or filling machine. Since the material web or sheet is, in such instance, advanced at a rate which corresponds to the production output rate of the packing machine (normally one or two packaging containers per second), there is reasonable time available for making possible both correct application of the tabs onto the packaging material and heat sealing to the thermoplastic-coated outer surface of the material. Since the equipment for applying and heat sealing the tabs to the packaging material web or sheets, on the one hand, renders the packaging machine more complicated and, on the other hand, necessitates the supply and handling of strip-shaped material or finished tabs, a need has been expressed in the art for the tabs to be applied in the correct position on the packaging material already in connection with its manufacture, for example while it is handled in web form in different conversion machines and provided with crease line patterns, printed text or the like. Since however conversion machines operate at very high speed, typically of the order of between 400 and 500 meters per minute, it has hitherto been impossible to provide application of tabs in the correct position at sufficiently high speed.

OBJECTS OF THE INVENTION

The Method

For the above-outlined reasons, it is desirable in this art to be able to realise a method for applying tabs to a continuous material web, a method which may be utilised for applying tabs to a material web in a conversion machine operating at high speed, the material web being advanced at its normal operational speed, i.e. between 400 and 500 meters/min.

A further object of the present invention is to realise an application method which makes it possible, under the above-outlined conditions, to apply tabs in register to a movable material web with great precision and reliability.

Yet a further object of the present invention is to realise a simple and reliable method for correcting the position of an individual tab during transfer so that the desired register maintenance is guaranteed.

Solution

The above and other objects have been attained according to the present invention in that a method of the type disclosed by way of introduction has been given the characterizing feature that the tabs are transferred, in a supply station, each to a retainer jaw displaceable along the periphery of the wheel the jaw moving the tab, while the wheel is in rotation, into contact with one of several uniformly spaced abutments disposed along the periphery of the wheel whereafter the tab is transferred to the web in a deposit station.

OBJECTS OF THE INVENTION

The Apparatus

It is further desired in the art to be able to provide an apparatus for applying tabs to a continuous material web, the apparatus being disposable in a conversion machine and, with good precision and reliability, applying tabs during operation of the conversion machine while this is working at its normal speed, i.e. between 400 and 500 meters/min.

A further object of the present invention is to realise an application apparatus which not only applies tabs in the correct position on a material web but also removes the tabs at the desired speed from a continuous material web associated with the tabs proper.

Still a further object of the present invention is to realise an application apparatus which is compact, uncomplicated and capable of being produced at relatively low cost.

Yet a further object of the present invention is to realise an application apparatus for tabs, the apparatus not suffering from any of the drawbacks inherent in prior art apparatuses.

Solution

These and other objects have been attained according to the present invention in that an apparatus of the type disclosed by way of introduction has been given the characterizing feature that the wheel carries, along its periphery, a number of abutments disposed in uniform spaced apart relationship, and a number of retainer jaws which are peripherally displaceable in relation to the abutments.

Advantages

By providing a method and an apparatus for adjusting the position of the tab, during transfer of the individual tabs from the supply station to a deposit station, to the correct positioning against the fixed abutment, correct deposition will be ensured of the individual tabs in register with irregularities provided on the material web, for example prefabricated pouring spouts or apertures, crease lines or print patterns. The uncomplicated pattern of movement and the relatively short movement distances ensure harmonious and smooth operation which guarantees sustained precision and reliability both at high speed and during lengthy operation.

BRIEF DESCRIPTION OF THE ACCOMPANYING DRAWINGS

One preferred embodiment of both the method and the apparatus according to the present invention will now be described in greater detail hereinbelow, with particular reference to the accompanying schematic Drawings which show only those details essential to an understanding of the present invention. In the accompanying Drawings:

FIG. 1 is a schematic, side elevation of an apparatus according to an embodiment of the present invention; and FIG. 2 is a partially cross-sectional perspective view of a portion of an apparatus according to an embodiment of the present invention.

DESCRIPTION OF PREFERRED EMBODIMENT

Figure 1:
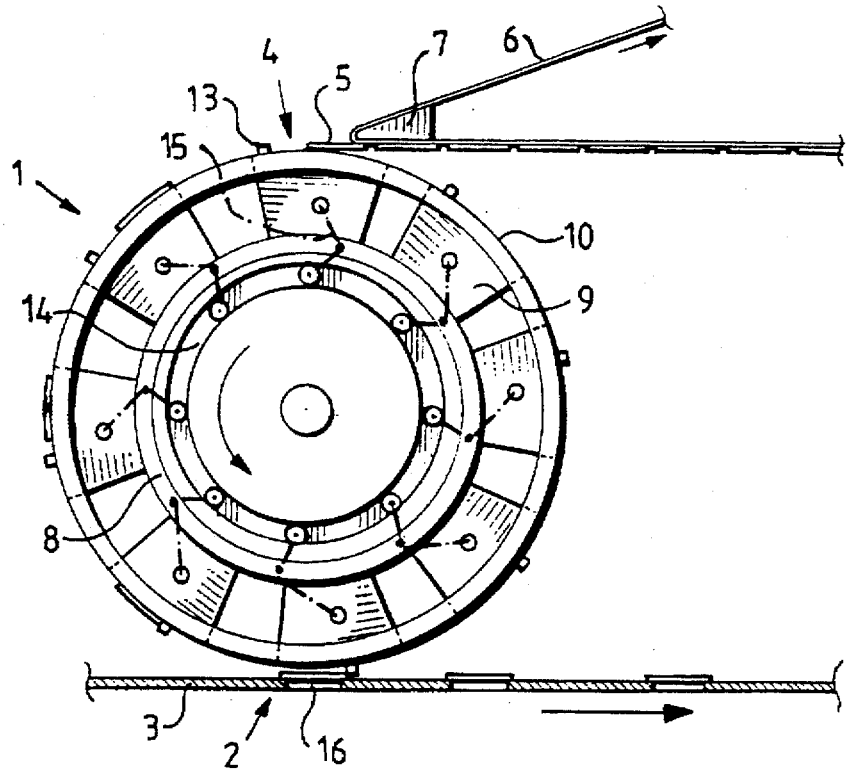
Figure 2:
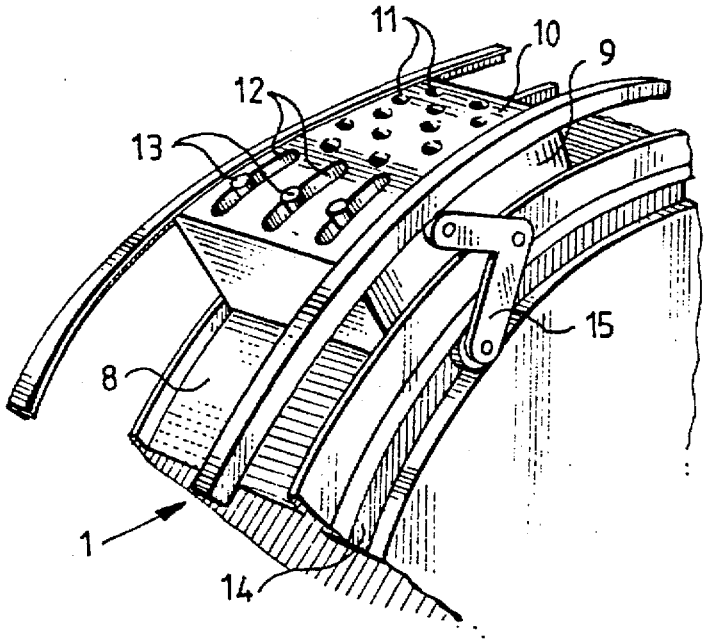

The schematic side elevation of FIG. 1 shows, in principle, the method and the apparatus according to the present invention, as these may be designed for transferring tabs in register to a web conveyed at high speed through a conversion machine. In such instance, use is made of a wheel 1 which, in a deposit station 2, abuts with its periphery against a material web 3 advanced by the conversion machine from left to right in FIG. 1. At the diametrically opposed side of the wheel 1, there is disposed a supply station 4 in which tabs 5 are transferred with the aid of a magazine or carrier strip 6 to the periphery of the wheel when the strip 6 passes a deflector device 7.

The wheel 1 located between the supply station 4 and the deposit station 2 displays a groove 8 extending about its periphery and accommodating a number (eight in number) of retainer jaws 9 displaceable along the periphery of the wheel. The wheel 1 is divided into a number of circle sectors within each one of which a retainer jaw 9 is disposed for reciprocal movement (seen in the direction of rotation of the wheel) in the groove 8. Each retainer jaw 9 includes an active surface or work surface 10 which coincides with the peripheral surface of the wheel and in which discharge a number of vacuum ducts 11. At the forward end of the work surface 10 (seen in the direction of rotation of the wheel, i.e. counterclockwise), there are a number of oblong pin grooves 12 extending radially through the jaw 9 and in which are housed pins 13 serving as abutments, the pins extending slightly radially outside the work surface 10 of the jaw so that, on one side, they display an abutment surface flush with the surface of the jaw. The pins 13 are fixedly disposed in relation to the wheel 1 (at the bottom of the groove 8), the pin grooves 12 being of such length that the jaw may move reciprocally within its circle sector, without hindrance by the pins 13. The pins are depressable towards the centre of the wheel, i.e. are radially movable against the action of springs (not shown).

Each retainer jaw 9 is connected to drive means 14 consisting of a fixedly disposed cam curve in which runs a cam follower 15 connected to each retainer jaw 9. The cam followers 15 comprise angle levers which, at their curved portion, are pivotally journalled in the wheel 1 and are pivotally journalled in the retainer jaw 9 at their end facing away from the cam curve. The cam curve is of such configuration that each retainer jaw is displaced with the aid of the cam follower 15 between a forward and rear position within each respective circle sector during one revolution of the wheel 1.

Via flexible connection conduits (not shown), the vacuum ducts 11 discharging in the work surface 10 of the retainer jaw are connected to a vacuum source of known type, for example a fan or a vacuum tank connected to a compressor. The size of the vacuum is, of course, adjustable—like the time during which the vacuum source is to be connected to the vacuum ducts 11 of each respective retainer jaw 9. The physical mechanics of the retainer jaw, i.e. stroke length and pattern of movement, may naturally also be adjusted in a conventional manner.

The wheel 1 is driven at a peripheral speed which wholly corresponds to the speed of movement of the material web 3. In such instance, it is ensured that the wheel 1—or more precisely its uniformly interspaced abutments or pins 13—is rotated in register with the repetitively recurring irregularities on the material web 3 which determine the placing of the individual tabs 5. Such irregularities may, for example, be in the form of prefabricated pouring apertures or holes 16 or consist of some other type of irregularity, for example transverse crease lines, printed markings or the like.

When tabs 5 are to be transferred to the material web 3 using the method and apparatus according to the present invention, the wheel 1 is first caused to rotate at a peripheral speed which corresponds to the speed of advancement of the material web 3, at the same time as the position of rotation of the wheel 1 is adjusted until such time as the abutments or pins 13 are located in the correct register position in relation to the irregularities or holes 16 on the material web 3. The wheel 1 is brought into abutment against the material web 3 at the same time as advancement of individual tabs 5 to the supply station 4 is commenced. This is effected in that the magazine or carrier strip 6 is fed past the deflector device 7, which folds the strip double in such a manner that the individual, releasable tabs 5 connected to the magazine strip 6 loosen from the strip and are transferred to the work surface 10 on one of the retainer jaws 9 of the wheel 1. The magazine or carrier strip 6 is advanced by a drive motor (not shown) which ensures that the strip 6 when emptied of tabs is wound up on a magazine reel (not shown). When a tab 5 is transferred to the wheel 1, i.e. progressively comes into contact with the work surface 10 of a retainer jaw 9, the vacuum ducts 11 of the retainer jaw are in communication with the vacuum source so that the tab, when placed on the area of the work surface displaying a pattern of discharging vacuum ducts 11, is retained at the work surface by means of the vacuum. In this situation, the vacuum should not be more powerful than permits the tab to be displaced over the surface against a certain resistance, as will be explained in greater detail hereinbelow.

On the transfer of an individual tab 5 to a retainer jaw 9, the retainer jaw is located in its rear position seen in the direction of rotation of the wheel 1, i.e. at the rearmost return position of the reciprocal movement described by the jaw with the aid of the drive means 14 within its circle sector on rotation of the wheel 1 (shown in FIG. 1). In this instance, the transferred tab 5 will cover at least a part of the vacuum ducts 11 discharging in the work surface and will thereby be retained, after transfer from the magazine or carrier strip 6. On continued counterclockwise rotation of the wheel, the cam curve 14 will, via the cam follower 15, progressively drive the pertinent retainer jaw 9 forwards in the direction of rotation of the wheel 1 until the retainer jaw 9 has been displaced so far forward that the entire length of the pin groove 12 has been utilised, i.e. the pin 13 is located close to the rear end of the groove 12 (seen in the direction of rotation of the wheel 1). During the forward movement of the retainer jaw 9, the tab 5 retained by the vacuum will come into contact, with its forward end, with the abutments or pins 13, which prevents the tab 5 from accompanying the retainer jaw 9 in its continued forward movement in a direction towards the forward return position of the jaw. Against the action of the vacuum and the forward movement of the retainer jaw 9, the tab 5 will thus remain in a defined position with its forward edge positioned against the stationary abutments or pins 13, whereby the position of the tab within its relevant circle sector is well defined. Since the wheel 1 has previously been oriented so that the abutments 13 come into contact with the material web with the desired register maintenance, the individual tabs 5 can now be transferred to the web 3 in the correct, predetermined register position, i.e. so that they, when coming into contact with the material web 3, are located in the correct register position in relation to the previously mentioned irregularities or holes 16. The transfer to the material web 3 is effected by the abutment pressure of the web against the periphery of the wheel 1 (or more precisely the work surface 10 of the retainer jaws 9), in which event a glue or adhesive connecting the tabs 5 to the magazine or carrier strip 6 can be utilised for ensuring that the individual tabs 5 adhere to the material web 3 and do not fasten to the work surfaces 10 of the retainer jaws 9. In order to facilitate transfer, the communication between the vacuum source and the vacuum ducts 11 may possibly be discontinued in connection with each respective retainer jaw 9 passing the deposit station 2.

Since the type of both tab and material web may vary within broad limits, the method and the apparatus according to the present invention may need to be modified in different ways without departing from the spirit and scope of the inventive concept as herein disclosed. Thus, the supply of the tabs can, of course, take place in different ways, for example by severing from a strip, by punching against the work surface of the retainer jaw, by picking from a magazine or by other means. Similarly, the application of the tabs onto the material web may be put into effect using various methods, for example heat sealing, hot melt application or the like.

The method and the apparatus according to the present invention have proved to function satisfactorily at very high work speeds, and both accuracy of placement and reliability in general have proved to meet the highest of standards. The high work rate potential makes for the rational provision of packaging material, in connection with its manufacture, with the desired tabs or strip portions serving as tear-off strips or pull-tabs on the finished and filled packaging containers to which the material web is subsequently converted in packing or filling machines of known type.

The present invention should not be considered as restricted to that described above and shown on the Drawings, many modifications being conceivable without departing from the spirit and scope of the appended claims.

What is claimed is:

1. A method for regularly transferring tabs to a web, comprising the steps of:

rotating a wheel, the wheel having at least one retainer jaw and at least one abutment corresponding to the jaw, the jaw being movable along a periphery of the wheel and the abutment being disposed on the periphery of the wheel, and moving the web such that the wheel abuts against the web and has a peripheral speed corresponding to a speed of the web;

transferring, at a supply station, a tab to the jaw;

moving the jaw along the periphery of the wheel such that, while the wheel is rotated, the tab is moved into contact with the abutment;

transferring the tab in contact with the abutment to the web at a deposit station.

2. The method as claimed in claim 1, wherein the jaw is movable along the periphery of the wheel within a circular sector, the jaw being located, when it passes the supply station, in a rear position in which a tab is transferred to the jaw, the jaw, after passing the supply station, being moved to a forward position such that a front edge of the tab is brought into contact with the abutment.

3. The method as claimed in claim 1, the jaw is, during at least part of the rotation of the wheel, in communication with a vacuum source for retaining the tab on a peripheral work surface of the jaw.

4. The method as claimed in claim 1, wherein the wheel includes a plurality of abutments and jaws arranged peripherally about the wheel, each of the jaws having transferred thereto at least one tab as the jaws pass the supply station.

5. The method as claimed in claim 4, wherein the abutments are uniformly spaced.

6. An apparatus for transferring tabs to a web such that the tabs are in register with previously provided markings on the web, comprising:

a rotary wheel;

at least one abutment disposed on a periphery of the wheel; and at least one retainer jaw corresponding to the abutment, the retainer jaw being movable along the periphery of the wheel relative to the abutment, wherein the abutment is stationary and is provided with an abutment surface flush with a peripheral work surface of the jaw, and the abutment includes a radial pin which extends outside of the work surface of the jaw through a groove in the jaw.

7. The apparatus as claimed in claim 6, the jaw is displaceably journalled in grooves extending about the periphery of the wheel, and is individually connected to drive means for moving the jaw along the periphery of the wheel relative to the abutment between a forward and a rear position.

8. The apparatus as claimed in claim 7, wherein the drive means includes a fixed cam curve and a cam follower, the cam follower being associated with the jaw.

9. The apparatus as claimed in claim 1, wherein the pin is radially movable and spring-biased in a direction away from a center of the wheel.

10. The apparatus as claimed in claim 6, further comprising one or more vacuum ducts extending to a work surface of the jaw, the ducts communicating with a vacuum source during at least part of the rotation of the wheel.

11. The apparatus as claimed in claim 10, wherein communication between the ducts and the vacuum source is reduced at a deposit station at which the tab is applied to the web.

12. The apparatus as claimed in claim 6, wherein the wheel includes a plurality of abutments and jaws arranged peripherally about the wheel.

13. The apparatus as claimed in claim 12, wherein the abutments are uniformly spaced.

14. The apparatus as claimed in claim 12, wherein drive means reciprocate the jaws through sectors of the wheel corresponding to the jaws.

* * * * *